US008961203B2

(12) United States Patent
Lee

(10) Patent No.: US 8,961,203 B2
(45) Date of Patent: Feb. 24, 2015

(54) BATTERY MANAGEMENT SYSTEM CONNECTOR FOR VEHICLE

(71) Applicant: Hyundai Motor Company, Seoul (KR)

(72) Inventor: Wan Lee, Jeonbuk (KR)

(73) Assignee: Hyundai Motor Company, Seoul (KR)

( * ) Notice: Subject to any disclaimer, the term of this patent is extended or adjusted under 35 U.S.C. 154(b) by 136 days.

(21) Appl. No.: 13/681,982

(22) Filed: Nov. 20, 2012

(65) Prior Publication Data

US 2014/0065859 A1 Mar. 6, 2014

(30) Foreign Application Priority Data

Sep. 5, 2012 (KR) ..... 10-2012-0098175

(51) Int. Cl.
*H01R 13/44* (2006.01)
*H01R 13/64* (2006.01)

(52) U.S. Cl.
CPC ..... *H01R 13/64* (2013.01); *Y10S 439/9242* (2013.01)
USPC ..... 439/142; 439/924.2

(58) Field of Classification Search
CPC ..... H01R 13/4532; H01R 13/4536; H01R 13/6275; H01R 13/639; H01R 13/64
USPC ..... 439/138, 345, 924.2, 142, 299, 631
See application file for complete search history.

(56) References Cited

U.S. PATENT DOCUMENTS 5,363,460 A * 11/1994 Marazzi et al. ..... 385/70
6,595,696 B1 * 7/2003 Zellak ..... 385/72
6,685,362 B2 * 2/2004 Burkholder et al. ..... 385/78
6,688,780 B2 * 2/2004 Duran ..... 385/76
6,964,585 B2 11/2005 Blichasz et al.
7,083,440 B2 * 8/2006 Shen et al. ..... 439/138
7,108,558 B2 * 9/2006 Zhu et al. ..... 439/630
7,612,993 B1 * 11/2009 Takei et al. ..... 361/679.31
7,641,484 B2 * 1/2010 Cha et al. ..... 439/138
7,703,987 B2 * 4/2010 Kramer et al. ..... 385/55
7,785,018 B2 * 8/2010 Jones et al. ..... 385/73
7,821,370 B1 * 10/2010 Shu et al. ..... 336/107
7,828,584 B2 11/2010 Neumetzler
8,011,946 B2 * 9/2011 Chen et al. ..... 439/345
8,337,222 B2 * 12/2012 Hung et al. ..... 439/138
8,353,711 B2 * 1/2013 Huang et al. ..... 439/138
8,500,469 B2 * 8/2013 Takai ..... 439/159
8,690,459 B2 * 4/2014 Lin et al. ..... 385/93
2002/0081901 A1 6/2002 Ma et al.

FOREIGN PATENT DOCUMENTS

JP 2005322574 A 11/2005
JP 2008130420 A 6/2008

* cited by examiner

*Primary Examiner* — Thanh Tam Le

(74) *Attorney, Agent, or Firm* — Mintz Levin Cohn Ferris Glovsky and Popeo, P.C.; Peter F. Corless

(57) ABSTRACT

Disclosed is a safety connector which can prevent "latch-up" of a battery management system (BMS) for managing a battery in a hybrid electric vehicle. The BMS connector requires that connectors be inserted into a connector base in a specific order. In particular, a first connector must first be inserted into a first connector insertion port to unlock a locking module disposed between the first connector insertion port and a second connector insertion port before any connector can be inserted into the second connector port.

11 Claims, 5 Drawing Sheets

BATTERY MANAGEMENT SYSTEM CONNECTOR FOR VEHICLE

CROSS-REFERENCE TO RELATED APPLICATION

This application claims under 35 U.S.C. §119(a) the benefit of Korean Patent Application No. 10-2012-0098175 filed Sep. 5, 2012, the entire contents of which are incorporated herein by reference.

BACKGROUND (a) Technical Field

The present invention relates to a battery management system (BMS) connector for a vehicle. More particularly, the present invention relates to a safety connector which can prevent latch-up of a BMS for managing a battery in a hybrid electric vehicle.

(b) Background Art

Generally, a hybrid electric vehicle uses an internal combustion engine and a motor using power from a battery as a source of power. Frequently, lithium batteries are used as the power source for the motor in hybrid electric vehicles. Lithium batteries can be classified into two groups, a lithium ion battery, which uses a liquid electrolyte, and a lithium polymer battery, which uses a solid polymer electrolyte.

These high-voltage batteries are typically manufactured in the form of a single module or group by connecting about 50 to 100 cells in series according to a desired capacity of the battery.

For example, a series-type hybrid vehicle, the engine acts as an energy source to rotate an electric generator to charge a battery. In this system, the electrical-generation capacity is determined according to the power consumed in a driving motor for driving the vehicle and a charging the battery. A generator control unit (GCU) is typically implemented to determine the electric-generating capacity. The GCU receives information from a motor control unit (MCU) of a battery management system (BMS) so that the electric-generating capacity can be determined.

A BMS is typically implemented in a hybrid vehicle to manage the vehicles large capacity battery system. Some portions or the entire internal circuit of the BMS may be damaged due to a simple error during assembly of components of the BMS, which results from a "latch-up" phenomenon due to surge.

"Latch-up" is a term typically used in the area of integrated circuits (ICs) to describe a particular type of short circuit which can occur in an improperly designed or damaged circuit. More specifically, a "latch-up" is an inadvertent creation of a low-impedance path between the power supply rails of, e.g., a MOSFET circuit, triggering a parasitic structure which disrupts proper functioning of the BMS, possibly even leading to destruction of the BMS due to overcurrent. Therefore, a power cycle is typically required to correct this situation.

For example, as shown in FIG. 1, connectors (not shown) should be sequentially inserted into four connector insertion ports 11 provided to a connector base 10. That is, the connectors should be inserted into the four connector insertion ports 11 in the order of ①→②→③→④. Accordingly, if the components are not inserted in that particular order, the components may be damaged due to a mistake that the insertion order of the connectors is changed due to worker's carelessness, etc. in assembling of the connectors.

Some techniques have been proposed as possible solutions to the above problem, (e.g., U.S. Pat. No. 7,828,584, U.S. Patent Publication No. 2002-0081901, Japanese Patent Application Publication No. 2008-0130420, Japanese Patent Application Publication No. 2005-0322574, etc.), however, most of these solutions involve surge protection. Therefore, it is still very difficult to prevent workers on the assembly line from incorrectly ordering the connectors.

The above information disclosed in this Background section is only for enhancement of understanding of the background of the invention and therefore it may contain information that does not form the prior art that is already known in this country to a person of ordinary skill in the art.

SUMMARY OF THE DISCLOSURE

The present invention has been made in an effort to solve the above-described problems associated with prior art. Accordingly, the present invention provides a battery management system (BMS) connector for a vehicle. The BMS connector may be implemented as a safe connector to prevent latch-up of a BMS, which allows connectors to be respectively inserted into connector insertion ports in such a manner that a second connecter can only be inserted into a second connector insertion port once a first connector is inserted into a first connector insertion port.

The BMS connector is implemented by providing a locking module within the connector insertion ports into which each of the respective connectors are inserted respectively, so that each of the connectors can be inserted into the connector insertion ports in only a specific predetermined order, thereby protecting a high-priced component and remarkably reinforcing safety during assembly of the connectors.

In one aspect, the present invention provides a BMS connector, including: a connector base configured to have a plurality of connector insertion ports into which connectors are inserted, respectively; and a locking module configured to be pulled back by being rotated only by contact with a connector entering into one connector insertion port while having a structure rotatable in one direction on a boundary between the connector insertion ports in the connector base. The connectors therefore are sequentially inserted into the connector insertion ports in only a specific predetermined order, thereby preventing damage of a component due to improper assembly.

In an exemplary embodiment, the locking module may include a locking lever having one or more contact pieces respectively formed in both sides thereof, which are rotatable about a shaft mounted on the connector base and contact the connectors, and a spring which is supported by being inserted around the circumference of the shaft and elastically supports the locking lever in one direction while both end portions of the spring are stuck to the contact pieces of the locking lever, respectively.

In another exemplary embodiment, the spring may be a coil spring, and may be mounted in a structure in which a straight line bending portion of the spring is inserted into a groove portion formed in the shaft.

In still another exemplary embodiment, both the end portions of the spring may be formed by being respectively inserted into slots extended to both the contact pieces from the center of the locking lever so that the spring elastically supports the locking lever.

Other aspects and exemplary embodiments of the invention are discussed infra.

BRIEF DESCRIPTION OF THE DRAWINGS

The above and other features of the present invention will now be described in detail with reference to certain exemplary embodiments thereof illustrated the accompanying drawings which are given hereinbelow by way of illustration only, and thus are not limitative of the present invention, and wherein.

Figure 1:
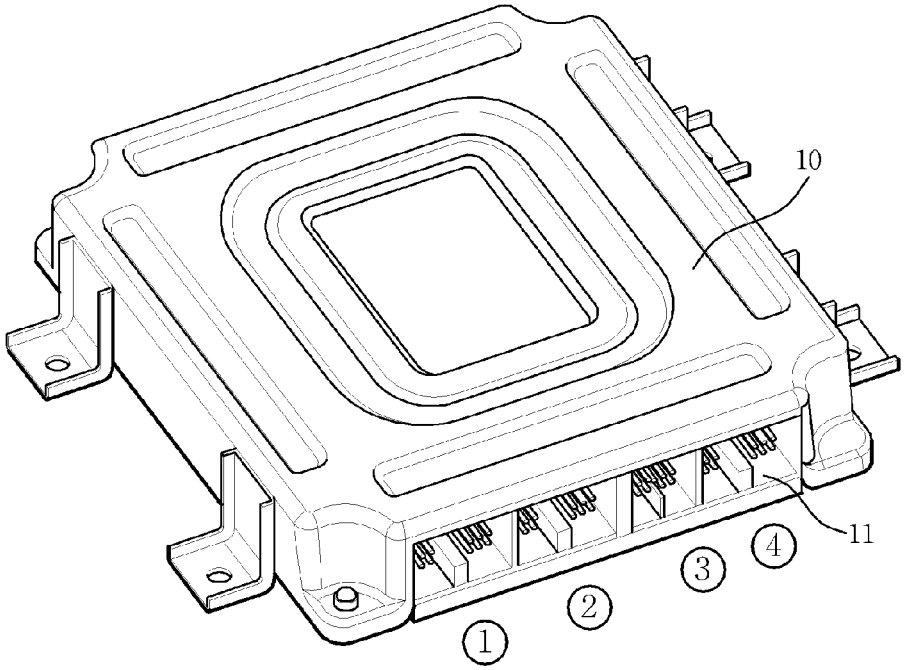
FIG. 1 PRIOR ART
FIG. 1 is a perspective view illustrating a conventional battery management system (BMS) connector.

It should be understood that the appended drawings are not necessarily to scale, presenting a somewhat simplified representation of various exemplary features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Hereinafter reference will now be made in detail to various embodiments of the present invention, examples of which are illustrated in the accompanying drawings and described below. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Figure 2:
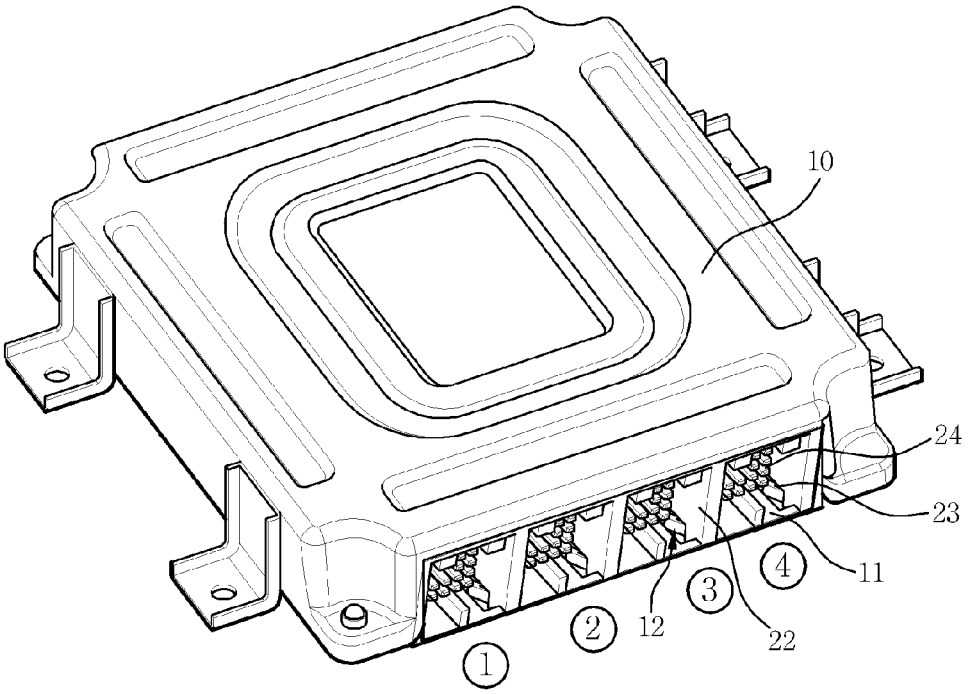
FIG. 2 is a perspective view illustrating a BMS connector according to an exemplary embodiment of the present invention.

FIG. 2 is a perspective view illustrating a battery management system (BMS) connector according to an embodiment of the present invention.

As shown in FIG. 2, the BMS connector includes a locking module that allows connectors to be inserted only in a predetermined order, so that it is possible to fundamentally prevent connectors from being inserted in the improper order.

To this end, a connector base 10 having a plurality of connector insertion ports 11 configured and structured to receive therein connectors (not shown) is provided on a front side of the BMS connector, and below bracket/key sets 24 for electrical connections with the connectors are assigned to the connector insertion ports 11 of the connector base 10, respectively.

The connector insertion ports 11 are partitioned into regions by wall bodies 22, so that one connector can be individually inserted into each connector insertion port 11. Within each region, a locking module 12 that selectively limits the entrance of each connector and allows the connector to be inserted into the connector insertion port 11 only in its predetermined order is mounted on a boundary line between the connector insertion ports 11, i.e., on the wall body 22 that partitions the connector insertion ports 11, so as to permit or limit the entrance of the connector through contact interference with the connector entering into the connector insertion port 11.

For example, a module mounting portion 23 may be provided in a predetermined space (e.g., a space formed by removing a portion of the wall body) on an inner lower side of the wall body 22. The locking module 12 having a structure rotatable in one direction may be mounted in the module mounting portion 23 provided as described above.

The locking module 12 is disposed to be simultaneously provided in the regions of the connector insertion ports 11 respectively formed on both sides of the respective regions with the wall body 22 interposed therebetween. Thus, the locking module 12 allows the connector to be inserted into each connector insertion port 11 while being pulled backward via the contact of the locking module 12 with the connector entering into the connector insertion port 11 or prevents the connector from being inserted into the connector insertion port.

For example, when the BMS connector is provided with four connector insertion ports 11 and three locking modules 12 respectively mounted on boundary lines between the connector insertion ports 11 along three inner wall bodies 22*i*, the connectors must be inserted into the connector insertion ports 11 in the exact order of ①→②→③→④ so that the insertion of the connectors is possible while the locking modules 12 sequentially operate (locking levers are sequentially pulled backward). If a first connector is not first inserted into ① but tries to be inserted instead into ②, or if a second connector is not inserted into ② but instead tries to be inserted into ③, etc., the insertion of the connectors is impossible since the locking module 12 will not operate (i.e., the locking lever is not rotated due to the insertion of the previous connector). As a result, the connectors must be inserted into the connector insertion ports 11 in the order of ①→②→③→④ in order for, in this example, all four connectors to be inserted in the BMS connector.

Figure 3:
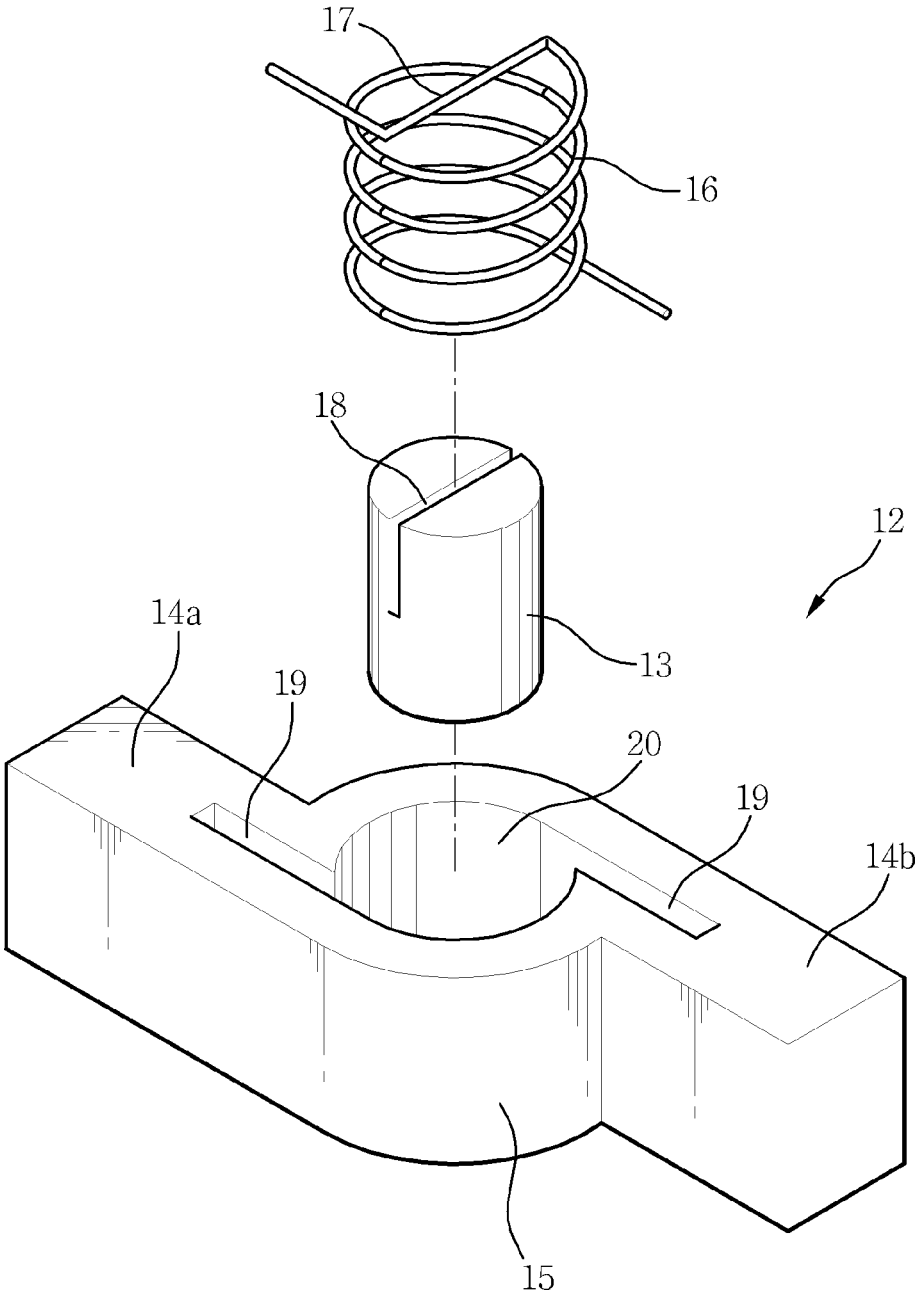
FIG. 3 is an exploded perspective view illustrating a locking module of the BMS connector according to the exemplary embodiment of the present invention.
Figure 4:
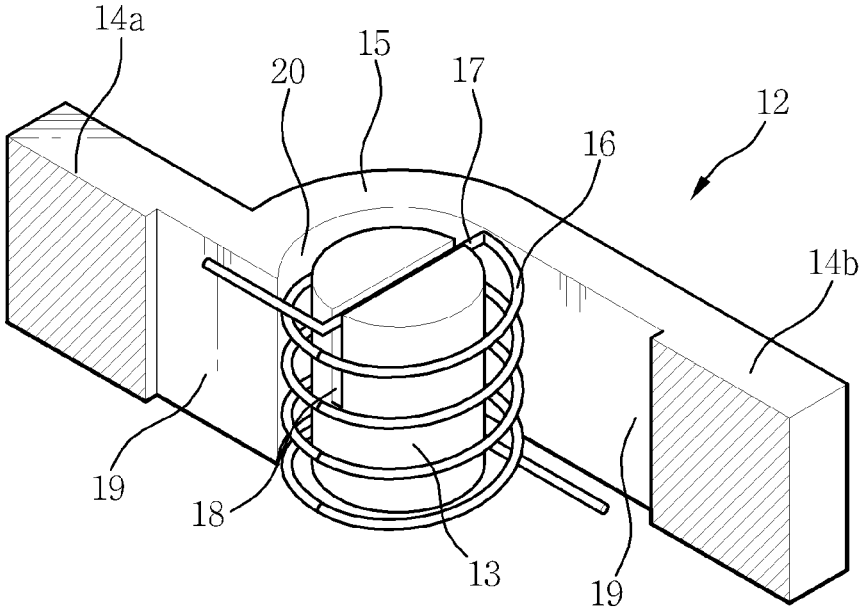
FIG. 4 is a sectional perspective view illustrating the locking module of the BMS connector according to the exemplary embodiment of the present invention.

FIG. 3 is an exploded perspective view illustrating the locking module of the BMS connector according to the exemplary embodiment of the present invention. FIG. 4 is a sectional perspective view illustrating the locking module of the BMS connector according to the exemplary embodiment of the present invention.

As shown in FIGS. 3 and 4, the locking module 12 is configured to be rotated backward (e.g., a counter-clockwise direction), when a previous connector is inserted into the first connector port. The locking module can only be unlocked by contact with the connector entering in one direction in the previous or first connector port, thus ensuring the appropriate order.

The locking module 12 includes a locking lever 15 having a cylindrical body having an aperture 20 formed at the center thereof and contact pieces 14*a* and 14*b* formed to extend in parallel in opposite directions from each other outward from the body, and a spring 16 as a means for elastically supporting the locking lever 15.

The locking lever 15 selectively limits the insertion of a subsequent connector from being inserted until a previous connected has been inserted in the preceding port. The locking lever 15 is mounted rotatably about a shaft 13 provided to the connector base 10 while being coupled to the shaft 13 through the aperture 20 of the body.

In the locking lever 15 mounted as described above, the body is positioned close to a slope-shaped stopper (21 of FIG. 5) formed inside the wall body 22. That is, the stopper 21 blocks an immediate back side of the body of the locking lever 15. In this case, one side of the locking lever 15 is pulled back in one direction and the other side of the locking lever 15 is blocked by the stopper 21. That is, the stopper 21 is formed in a slope shape parallel with the posture of the locking lever 15, which will be described later. Thus, stopper 21 enables the rotation of the locking lever 15 to be operated in one connector insertion port, and enables the rotation of the locking lever 15 to be blocked in another connector insertion port.

The locking lever 15 is mounted so that it is slightly sloped toward the entrance direction of the connector. For example, the end of the contact piece 14*a* positioned within the region of one connector insertion port 11 into which the connector will be first inserted faces an inside of the region, and simultaneously, an end of the contact piece 14*b* positioned within the region of another connect insertion port 11 into which the connector is will be next inserted while being adjacent to the one connector insertion port 11 faces an outside of the region so as to contact the connector entering into the region of the connector insertion port 11.

The spring 16 may be a coil spring, and upper and lower ends of the spring 16 may be formed to bend in opposite directions to each other. Thus, the upper and lower ends of the spring 16 can be fixed by being respectively inserted into slots 19 formed in both the contact pieces 14*a* and 14*b* of the locking lever 15. Here, the slots 19 may be respectively formed to extend into both the contact pieces 14*a* and 14*b* from the aperture 20 of the body.

A straight line bending portion 17 crossing the center of the coil spring is formed on one end portion of the spring 16, i.e., at an end portion of the upper end of the spring 16, so that the spring 16 can be fixed to the shaft 13 using the straight line bending portion 17. That is, a groove portion 18 is formed in the shaft 13. This groove portion 18 has a predetermined depth from the top surface to a lower portion of the shaft 13 and is formed over the diameter of the shaft 13. The shaft 13 is inserted into the spring 16 so that the spring may completely surround the shaft, and the straight line bending portion 17 is inserted into the groove portion 18 thereby fixing the spring 16 to the shaft and the locking lever body 15.

Accordingly, due to the elasticity of the spring, the locking lever 15 is able to return to a locked position when a connector is removed from the port. Thus, when an external force is applied to the locking lever 15 (e.g., when the locking lever 15 contacts the connector), the locking lever 15 may be rotated into an unlocked position in which the locking lever 15 is in a direction substantially parallel to the insertion direction of the of the connector. If the external force is removed, however, the locking lever 15 will return to its original sloped posture (i.e., a locked position).

Hereinafter, the operation state of the locking module in the BMS connector configured as described above will be described.

Figure 5:
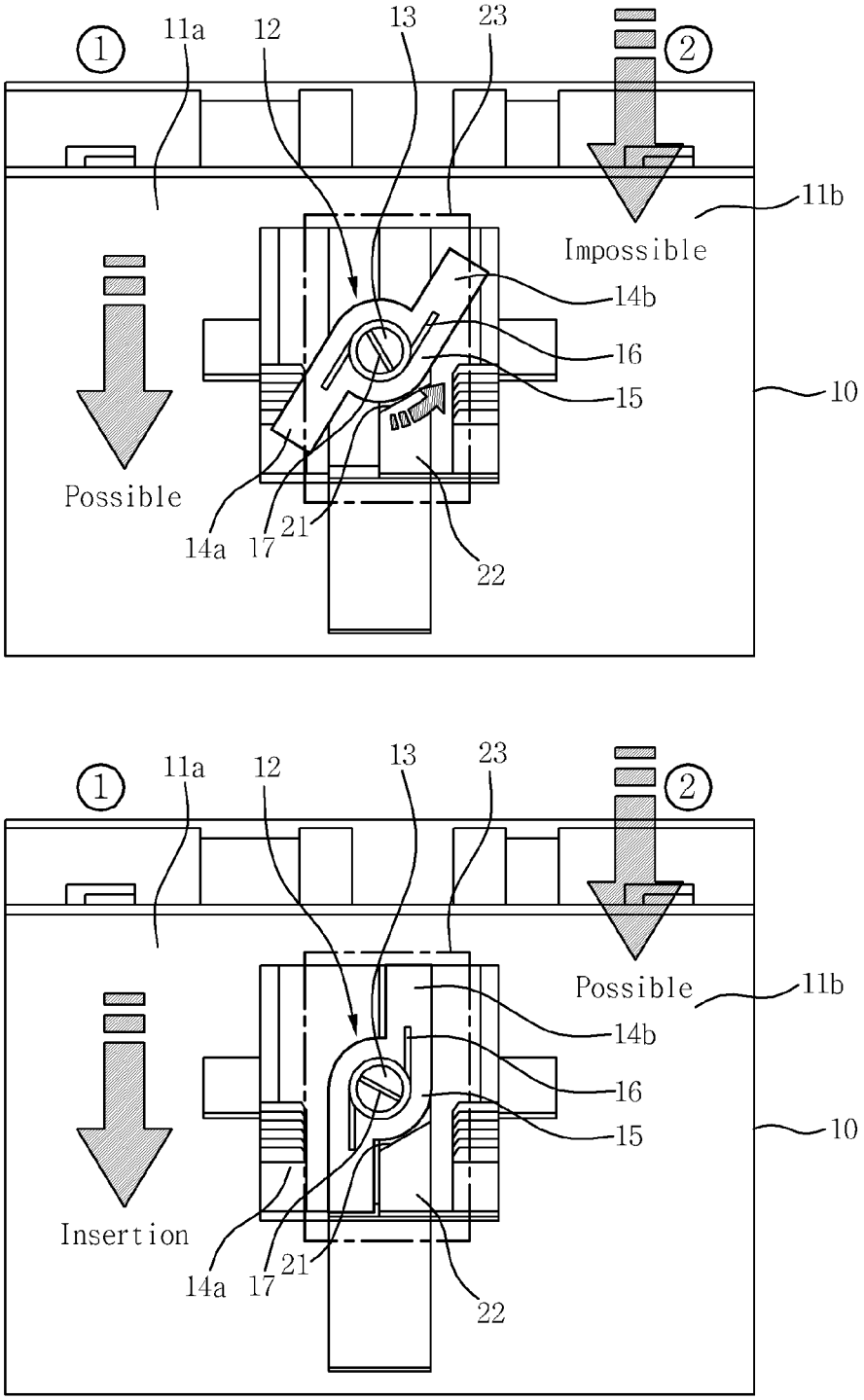
FIG. 5 is a plan view illustrating an operation state the locking module in the BMS connector according to the exemplary embodiment of the present invention.

FIG. 5 is a plan view illustrating an operation state the locking module in the BMS connector according to the embodiment of the present invention. The operational state of the locking module 12 mounted between the ① connector insertion port 11*a* and the ② connector insertion port 11*b* is shown in FIG. 5. It will be apparent that the locking modules 12 respectively mounted between ② and ③ and between ③ and ④ operate substantially the same.

The ① connector insertion port 11*a* is a connector insertion port into which the connector is set to be first inserted, and the ② connector insertion port 11*b* is a connector insertion port into which the connector is set to be next inserted. The locking module 12, i.e., the locking lever 15 supported by the shaft 13 together with the spring 16 is mounted to maintain a sloped posture between both the connector insertion ports 11*a* and 11*b*, which are formed in the connector base 10.

In this case, the end of the contact piece 14*a* of the locking lever 15 is positioned to face the inside in the region of the ① connector insertion port 11*a*, and the end of the contact piece 14*b* is positioned to face the outside in the region of the ② connector insertion port 11*b*. When a first connecter enters into the ① connector insertion port 11*a* in this state, the locking lever 15 is rotated by the insertion force of the first connector so that the locking mechanism rotates in the direction of the arrow shown in FIG. 5, and thus the insertion of the first connector into the ① connector insertion port is possible.

If, however, a worker attempts to insert the first connector into the ② connector insertion port 11*b* (i.e., no connector has yet been inserted into ① connector insertion port), the rotation of the locking lever 15 is blocked by the stopper 21, and therefore, the insertion of the first connector into the ② connector insertion port 11*b* is blocked.

However, when the first connector is inserted into the ① connector insertion port 11*a*, the locking lever 15 is in an unlocked position (e.g., in a direction parallel to the insertion direction). As a result, the connector entering into the ② connector insertion port 11*b* can be inserted into the ② connector insertion port 11*b* without any interference the locking module 15.

If the connectors are inserted into the connector insertion ports in the predetermined order of ①→②→③→④, the posture of the locking lever 15 is rotated into an unlocked position whenever the previous connector is inserted into previous connector insertion port, and thus the locking lever does not interfere with the next inserted connector. When the connectors are inserted into the connector insertion ports in an incorrect order, however, the connectors cannot be inserted into the connector insertion ports, so that it is possible to fundamentally prevent workers from inserting the connectors in an incorrect order.

According to the present invention, the BMS connector for the vehicle is provided with a locking module that enables connectors to be inserted into connector insertion ports in only a specific predetermined order, so that it is possible to fundamentally prevent assembly workers from inserting the connectors in an incorrect order and thus to remarkably reinforce safety during assembly of the connectors thereby protecting the BMS from becoming damaged The invention has been described in detail with reference to exemplary embodiments thereof. However, it will be appreciated by those skilled in the art that changes may be made in these embodiments without departing from the principles and spirit of the invention, the scope of which is defined in the appended claims and their equivalents.

What is claimed is:

1. A battery management system (BMS) connector for a vehicle, comprising:

a connector base configured to have a plurality of connector insertion ports into which a plurality of connectors are inserted, respectively; and a locking module configured to be rotated in only one direction while a first connector of the plurality of connectors enters into a first connector insertion port of the plurality of connector insertion ports so that a second connector of the plurality of connectors sequentially enters into a second connector insertion port of the plurality of connector insertion ports, wherein the locking module prevents insertion of the second connector of the plurality of connectors into the first connector insertion port, and wherein the locking module requires that the plurality of connectors be inserted into the plurality of connector insertion ports respectively sequentially.

2. The BMS connector of claim 1, wherein the locking module further comprises a locking lever having contact pieces respectively formed on both sides thereof, the locking lever rotatable about a shaft mounted on the connector base and come in contact the plurality of connectors, and a spring provided around the circumference of the shaft and elastically supporting the locking lever in one direction, wherein both end portions of the spring are inserted into the contact pieces of the locking lever, respectively.

3. The BMS connector of claim 2, wherein the spring is a coil spring, and is mounted in a structure in which a straight line bending portion of the spring is inserted into a groove portion formed in the shaft.

4. The BMS connector of claim 2, wherein both the end portions of the spring are formed by being respectively inserted into slots extending into both the contact pieces from a center of the locking lever so that the spring elastically supports the locking lever.

5. A battery management system (BMS) connector for a vehicle, comprising:

a connector base configured to have a plurality of connector insertion ports into which a plurality of connectors are inserted, respectively; and a locking module configured to be rotated only one direction while a first connector entering into a first connector insertion port of the plurality of connector insertion ports so that a second connector of the plurality of connectors sequentially enters into a second connector insertion port of the plurality of connector insertion ports, wherein the locking module prevents insertion of the second connector of the plurality of connectors into the first connector insertion port, and.

6. The BMS connector of claim 5, wherein the locking module further comprises a locking lever having contact pieces respectively formed on both sides thereof, the locking lever rotatable about a shaft mounted on the connector base and come in contact the plurality of connectors, and a spring provided around the circumference of the shaft and elastically supporting the locking lever in one direction, wherein both end portions of the spring are inserted into the contact pieces of the locking lever, respectively.

7. The BMS connector of claim 6, wherein the spring is a coil spring, and is mounted in a structure in which a straight line bending portion of the spring is inserted into a groove portion formed in the shaft.

8. The BMS connector of claim 6, wherein both the end portions of the spring are formed by being respectively inserted into slots extending into both the contact pieces from a center of the locking lever so that the spring elastically supports the locking lever.

9. The BMS connector of claim 5, wherein the locking module requires that the plurality of connectors be inserted into the plurality of connector insertion ports respectively sequentially.

10. The BMS connector of claim 9, wherein in a locked position, a first end of the locking module projects into the first connector insertion port and a second opposite end projects into a second connector insertion port.

11. The BMS connector of claim 10, wherein in an unlocked position, the locking module is positioned in a direction parallel to an insertion direction of the plurality of connectors and the first and second end of the locking lever are rotated counter clockwise into the boundary.

* * * * *